US010373597B2

(12) United States Patent
Rubenstein

(10) Patent No.: US 10,373,597 B2
(45) Date of Patent: Aug. 6, 2019

(54) TRANSDUCER FOR A STRINGED MUSICAL INSTRUMENT

(71) Applicant: Ubertar LLC, Ridgewood, NY (US)

(72) Inventor: Paul Rubenstein, Ridgewood, NY (US)

(73) Assignee: Ubertar LLC, Ridgewood, NY (US)

( * ) Notice: Subject to any disclaimer, the term of this patent is extended or adjusted under 35 U.S.C. 154(b) by 17 days.

(21) Appl. No.: 15/598,935

(22) Filed: May 18, 2017

(65) Prior Publication Data

US 2018/0336873 A1 Nov. 22, 2018

(51) Int. Cl.

| | |
|---|---|
| ***G10H 3/18*** | (2006.01) |
| ***G10H 3/14*** | (2006.01) |
| ***H04R 3/08*** | (2006.01) |

(52) U.S. Cl.

CPC ..... *G10H 3/181* (2013.01); *G10H 3/143* (2013.01); *G10H 3/146* (2013.01); *G10H 3/186* (2013.01); *H04R 3/08* (2013.01); *G10H 2220/565* (2013.01)

(58) Field of Classification Search

CPC ..... G10H 3/181; G10H 3/146; G10H 3/186; G10H 2220/565; H04R 3/08

USPC ..... 84/726

See application file for complete search history.

(56) References Cited

U.S. PATENT DOCUMENTS 3,715,446 A * 2/1973 Kosinski ..... G10H 3/182 84/727
3,962,946 A * 6/1976 Rickard ..... G01V 3/107 84/726
3,983,777 A * 10/1976 Bartolini ..... G10H 3/181 84/726
4,096,780 A * 6/1978 Dawson ..... G10H 3/182 84/313
4,348,930 A * 9/1982 Chobanian ..... G10H 3/182 84/726
4,624,172 A * 11/1986 McDougall ..... G10H 3/181 84/726
4,878,412 A * 11/1989 Resnick ..... G10H 3/181 84/726
5,336,845 A * 8/1994 Lace, Sr. ..... G10H 3/181 84/726
5,610,357 A * 3/1997 Frank-Braun ..... G10H 3/181 84/726

(Continued)

*Primary Examiner* — David S Warren
*Assistant Examiner* — Christina M Schreiber
(74) *Attorney, Agent, or Firm* — Linda B. Huber; Nixon Peabody LLP

(57) ABSTRACT

A string-vibration transducer for an electric, stringed instrument that provides effective noise or hum cancellation while retaining single-coil tone. The transducer includes a permanent magnet, at least two ferromagnetic metal poles, a coil that is configured to loop around the at least one ferromagnetic metal pole, and a bottom flatwork comprising at least two apertures to receive the at least two ferromagnetic metal poles, wherein the permanent magnet comprises a north magnetic pole and a south magnetic pole, wherein the at least two ferromagnetic metal poles are configured to be displaced on top of the permanent magnet and through the at least one aperture on the bottom flatwork, wherein the coil is configured to loop around the at least two ferromagnetic metal poles to comprise two loops in a shape of figure eight, and wherein the bottom flatwork is configured to be on top of the permanent magnet.

14 Claims, 6 Drawing Sheets

(56) References Cited

U.S. PATENT DOCUMENTS

| | | | | |
|---|---|---|---|---|
| 5,789,691 | A * | 8/1998 | Stich | G10H 3/181 84/726 |
| 8,415,551 | B1 * | 4/2013 | Dixon | G10H 3/181 84/723 |
| 8,791,351 | B2 * | 7/2014 | Kinman | G10H 3/181 84/723 |
| 8,907,199 | B1 * | 12/2014 | Dixon | G10H 3/181 84/726 |
| 9,165,545 | B2 * | 10/2015 | Gelvin | G10H 3/181 |
| 9,552,802 | B2 * | 1/2017 | Jang | G10H 3/181 |
| 9,704,464 | B1 * | 7/2017 | Petschulat | G10H 3/181 |
| 9,818,389 | B2 * | 11/2017 | Beers | G10H 3/181 |
| 2002/0069749 | A1 * | 6/2002 | Hoover | G10H 3/26 84/738 |
| 2004/0168566 | A1 * | 9/2004 | Juszkiewicz | G10H 1/0058 84/723 |
| 2010/0122623 | A1 * | 5/2010 | Salo | G10H 3/181 84/726 |
| 2012/0103170 | A1 * | 5/2012 | Kinman | G10H 3/181 84/726 |
| 2012/0118129 | A1 * | 5/2012 | Jang | G10H 3/143 84/726 |
| 2012/0272815 | A1 * | 11/2012 | Lingel | G10H 3/143 84/726 |
| 2018/0336873 | A1 * | 11/2018 | Rubenstein | G10H 3/181 |

* cited by examiner

TRANSDUCER FOR A STRINGED MUSICAL INSTRUMENT

FIELD OF THE INVENTION

The present disclosure generally relates to transducer for a stringed instrument. More specifically, it relates to a transducer for a stringed instrument including a single coil in a shape of an infinity symbol.

BACKGROUND OF THE DISCLOSURE

Electric guitars generally come in two varieties—single coil and humbucker pickups. Single coil guitars typically consist of a single bar magnet wrapped within a coil or a plurality of permanent magnets wrapped within a coil that react to disturbances caused by the guitar's vibrating strings. These strings are made of a magnetically permeable material typically a ferromagnetic material (e.g., nickel, steel, and the like) and the magnetic lines of flux developed by the permanent magnets are intercepted by the vibrating strings. This causes variations in the field pattern and a varying current is caused to flow in the coils. The frequency of the current corresponds to (or tracks) the frequency of vibration of the strings.

Plucking the metal string causes the pickup to produce a low-powered electronic signal that corresponds to the string's vibrations. This signal is then amplified to a level capable of driving speakers. By producing sound waves, the speaker converts the electronic signal back into mechanical energy, mirroring the metal string's behavior.

The coils, as well as being influenced by vibration of the strings also are subjected to noise. Noise is produced by lighting, electric motors and appliances and other sources. This noise (or hum) adversely affects the quality of the sound reproduced by the pickups. The fundamental frequency of the electrical supply voltage, typically 50 Hz or 60 Hz, is converted into an audible hum in the amplifying equipment.

Leo Fender produced a single-coil pickup in the 1940s, the design of which is the basis for single-coil pickups made today. It picks up considerable hum along with the intended signals.

Seth Lover, working for the Gibson company in 1955, invented the humbucking pickup, also known as a "humbucker", which employs two coils in opposite phase to each other (e.g., if the first coil is clockwise, the second is counter-clockwise) and with the magnetic field for each coil in opposite polarity to each other. This cancels the unwanted noise (hum) while preserving the signal. It was a commercial success and humbuckers remain popular today.

However, in spite of the hum, single-coil pickups also remain popular. This is because a single-coil pickup produces a different kind of tone quality from a humbucker. This tone is favored by numerous guitar players. Many attempts have been made to produce a pickup, which has the tone quality and size of a traditional single-coil pickup, with the noise-canceling attributes of a humbucker. To date, all of these solutions have employed a second coil. Some have been essentially scaled-down versions of the humbucker concept. Others have two coils stacked one on the other, either with or without shielding in-between. Others have employed a "dummy coil", a coil set inside the pick guard or elsewhere where it is too far away from the strings to sense them; it is for noise-canceling only.

Any dual-coil design will necessarily have different properties from a single-coil design. If both coils sense the strings, two signals are combined, picking up different overtones than a single coil would. The impedance of the pickup is the result of the sum of the impedance of both coils. Impedance affects the amplitudes of the various frequencies in the signal transferred to the amplifier. This will affect tone regardless of whether or not the second coil is used to sense the strings.

Therefore, there is an unmet need in the market for a novel single-coil pickup that produces its unique tone quality while canceling out the hum.

SUMMARY OF THE DISCLOSURE

It is therefore an object of the present invention to provide an improved transducer or pickup for stringed musical instruments, which provides for effective noise or hum cancellation while retaining single-coil tone by utilizing a novel noise-canceling single-coil design.

According to one aspect of the invention, a transducer having a single coil of wire twisted into the number 8 (or infinity) shape is disclosed. The first loop of the 8 may be configured to surround a number of magnetic pole pieces (typically three) of the same magnetic polarity, and the second loop surrounding the same number of magnetic pole pieces with magnetic polarity opposite to the pole pieces surrounded by the first loop. The magnetic pole pieces may be made from ALNICO II or ALNICO V or any other suitable magnetic material. Alternatively, the pole pieces may be made from any magnetically permeable material (e.g., mild steel), with a bar magnet underneath each of the two sets of poles, such that the magnetic field produced by each magnet in the direction of the strings is opposite in polarity to the other.

The transducer may include non-metallic plates arranged above and below the coil. The non-metallic plates may include at least one hole for receiving the permanently magnetic or magnetically permeable pole pieces.

Due to the twist in the coil, each loop produces a signal, which is in opposite phase to the other. A string passes only over one loop, thus produces signal in only that loop. Noise is picked up equally by both loops, and is canceled as the out-of-phase signals are combined.

In one embodiment of the present disclosure, no pole pieces may be used. The looped coil may be placed directly over two magnets of opposite magnetic polarity on the side facing the strings such that each loop is associated with one magnet. The loop may include a shape produced by a curve that bends around and crosses itself.

EMBODIMENTS

Embodiment 1

A string-vibration transducer for an electric instrument having strings comprising:

two permanent magnets;

at least two ferromagnetic metal poles;

a coil that is configured to loop around the at least one ferromagnetic metal pole; and a bottom flatwork comprising at least two apertures to receive the at least two ferromagnetic metal poles, wherein each permanent magnet comprises a north magnetic pole and a south magnetic pole, wherein the at least two ferromagnetic metal poles are configured to be displaced on top of the permanent magnets and through the at least one aperture on the bottom flatwork, wherein the coil is configured to loop around the at least two ferromagnetic metal poles to comprise two loops in a shape of figure eight, and wherein the bottom flatwork is configured to be on top of the permanent magnets.

Embodiment 2

The transducer of Embodiment 1, wherein the permanent magnet associated with the first loop of first ferromagnetic metal pole is magnetically polarized opposite to the permanent magnet associated with the second loop of second ferromagnetic metal pole.

Embodiment 3

The transducer of Embodiment 1, wherein the bottom flatwork comprises a non-metallic plate.

Embodiment 4

The transducer of Embodiment 1, wherein the at least two ferromagnetic metal poles are configured to transfer the magnetic field of the permanent magnets through their length.

Embodiment 5

The transducer of Embodiment 1, wherein the at least two ferromagnetic metal poles are cylindrical in shape.

Embodiment 6

The transducer of Embodiment 1, wherein the at least two ferromagnetic metal poles are made from at least one of: ALNICO II, ALNICO III, ALNICO V, ARNICO VIII, mild steel, of any combination thereof.

Embodiment 7

The transducer of Embodiment 2, wherein the first ferromagnetic metal pole is arranged within the first loop of the coil such that the first ferromagnetic metal pole and the first loop of the coil have same magnetic polarity.

Embodiment 8

The transducer of Embodiment 2, wherein the second ferromagnetic metal pole is arranged within the second loop of the coil such that the second ferromagnetic metal pole and the second loop of the coil have same magnetic polarity.

Embodiment 9

The transducer of Embodiment 1, wherein the permanent magnets comprise a pair of adjacent rectangular magnets, magnetized through the thickness, such that the magnetic fields face the strings.

Embodiment 10

The transducer of Embodiment 1, wherein the permanent magnets are configured to be underneath the two loops of the coil.

Embodiment 11

The transducer of Embodiment 1, wherein the coil has between 1,000 to 9,000 turns.

Embodiment 12

The transducer of Embodiment 1, wherein the coil has more than 9,000 turns.

Embodiment 13

The transducer of Embodiment 1, wherein the coil has less than 1,000 turns.

Embodiment 14

The transducer of Embodiment 1, wherein the coil has about 6,000 turns.

Embodiment 15

A string vibration transducer for an electric instrument having strings comprising:

at least two magnetic poles, a coil that is configured to loop around the at least two magnetic poles, and a bottom flatwork comprising at least two apertures to receive the at least two magnetic poles, wherein the at least two magnetic poles comprise a north magnetic pole and a south magnetic pole, wherein the at least two magnetic poles are further configured to be displaced on top of the bottom flatwork and through the at least one aperture on the bottom flatwork, wherein the coil is configured to loop around the at least two magnetic poles to comprise two loops in a shape of figure eight, and wherein the bottom flatwork is configured to be below the at least two magnetic poles and the coil.

Embodiment 16

The transducer of Embodiment 15, further comprising a coil terminal that is configured to allow, via soldering, an electrical connection to be made between the coil ends and more robust, insulated wires which carry the signal to the rest of the circuit.

Embodiment 17

The transducer of Embodiment 15, further comprising a top flatwork that fits over the coil and the at least two magnetic poles.

Embodiment 18

The transducer of Embodiment 15, wherein the at least two magnetic poles are comprised of a ferromagnetic material, typically but not limited to steel, e.g. iron, nickel, cobalt and alnico.

Embodiment 19

The transducer of Embodiment 15, wherein the first loop of the coil around the north magnetic pole has same magnetic polarity as the north magnetic pole.

Embodiment 20

The transducer of Embodiment 15, where in the second loop of the coil around the south magnetic pole has same magnetic polarity as the south magnetic pole.

BRIEF DESCRIPTION OF THE DRAWINGS

Exemplary embodiments are illustrated in referenced figures. It is intended that the embodiments and figures disclosed herein are to be considered illustrative rather than restrictive.

DETAILED DESCRIPTION OF THE DISCLOSURE

Figure 1:
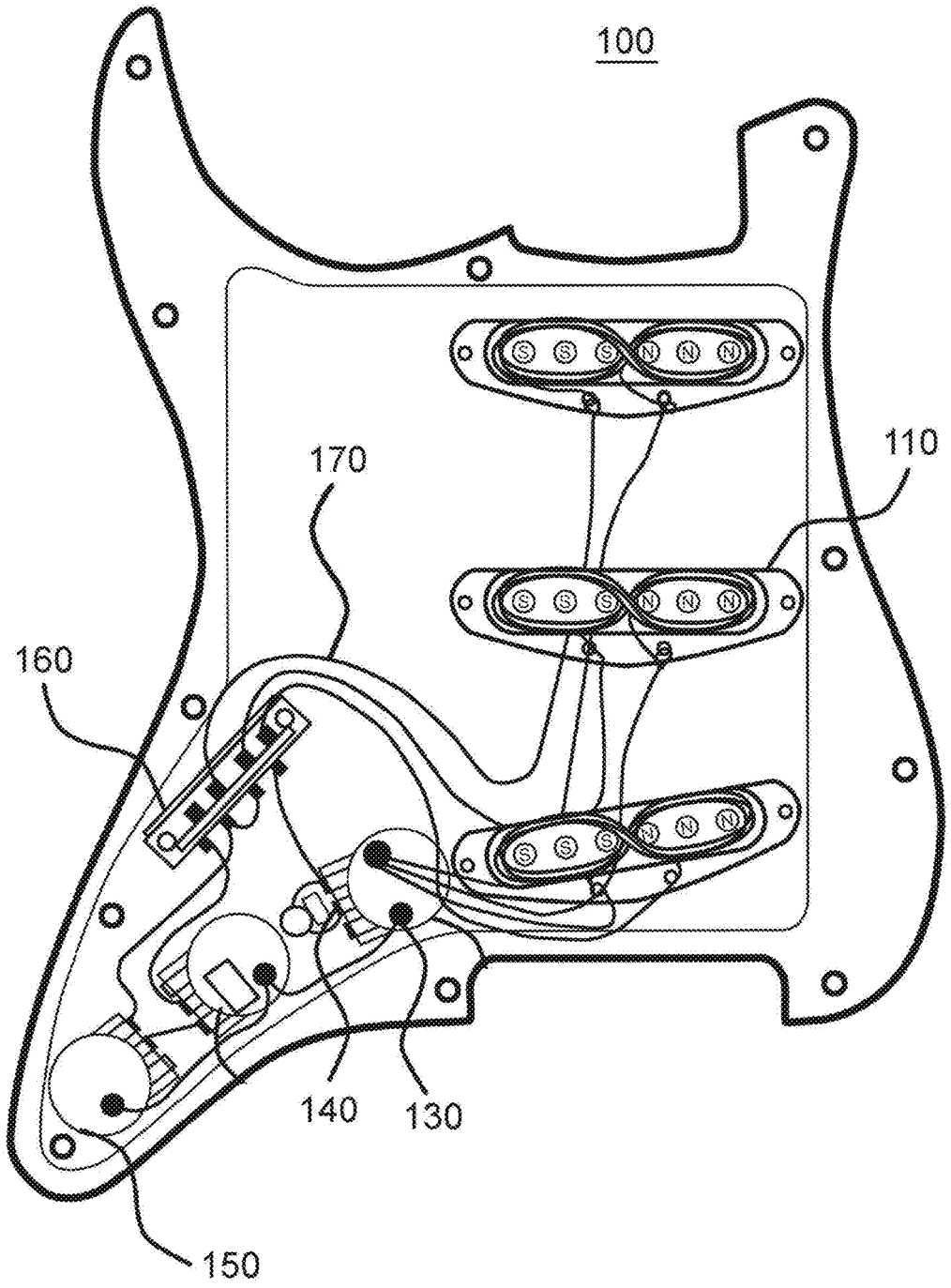
FIG. 1 illustrates a guitar with an example of a transducer that is constructed in accordance with the principles of the present disclosure.

The disclosure and the various features and advantageous details thereof are explained more fully with reference to the non-limiting implementations and examples that are described and/or illustrated in the accompanying drawings, and detailed in the following description. It should be noted that the features illustrated in the drawings are not necessarily drawn to scale, and features of one implementation may be employed with other implementations as any person skilled in the art would recognize, even if not explicitly stated herein. Descriptions of well-known components and processing techniques may be omitted so as to not unnecessarily obscure the implementations of the disclosure. The examples used herein are intended merely to facilitate an understanding of ways in which the disclosure may be practiced and to further enable those of skill in the art to practice the implementations of the disclosure. Accordingly, the examples and implementations herein should not be construed as limiting the scope of the disclosure.

Unless stated otherwise, or implicit from context, the following terms and phrases include the meanings provided below. Unless explicitly stated otherwise, or apparent from context, the terms and phrases below do not exclude the meaning that the term or phrase has acquired in the art to which it pertains. Unless otherwise defined, all technical and scientific terms used herein have the same meaning as commonly understood by one of ordinary skill in the art to which this invention belongs. It should be understood that this invention is not limited to the particular methodology, protocols, and reagents, etc., described herein and as such can vary. The definitions and terminology used herein are provided to aid in describing particular embodiments, and are not intended to limit the claimed invention, because the scope of the invention is limited only by the claims.

As used herein the term "comprising" or "comprises" is used in reference to compositions, methods, and respective component(s) thereof, that are useful to an embodiment, yet open to the inclusion of unspecified elements, whether useful or not. It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). Although the open-ended term "comprising," as a synonym of terms such as including, containing, or having, is used herein to describe and claim the invention, the present invention, or embodiments thereof, may alternatively be described using alternative terms such as "consisting of" or "consisting essentially of."

Unless stated otherwise, the terms "a" and "an" and "the" and similar references used in the context of describing a particular embodiment of the application (especially in the context of claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. The abbreviation, "e.g." is derived from the Latin exempli gratia, and is used herein to indicate a non-limiting example. Thus, the abbreviation "e.g." is synonymous with the term "for example." No language in the specification should be construed as indicating any non-claimed element essential to the practice of the application.

Overview

As disclosed herein, the present invention provides an improved transducer or pickup for stringed musical instruments, which provides for effective noise or hum cancellation while retaining single-coil design and sound.

FIG. 1 illustrates a guitar with an example of a transducer that is constructed in accordance with the principles of the present disclosure. The guitar 100 includes at least one transducer 110, a negative tone control 130, a positive tone control 140, a volume control 150, and toggle switch 160, all of which may be wired to each other to form a circuit. For instance, the at least one transducer 110, the negative tone control 130, the positive tone control 140, the volume control 150, and the toggle switch 160 may be connected to each other via one or more wires 170. The at least one transducer 110 includes a magnet that is surrounded by a coil. The magnet creates a magnetic field, which is disturbed by the mechanical vibrations produced by strings (not shown), changing magnetic flux and inducing an electric current thorough the coil, whereby such electric current is amplified to produce musical sounds. The transducer essentially captures or senses mechanical vibrations produced by musical instruments and converts them into an electrical signal that is then amplified by an amplifier then converted into musical sounds by, e.g., loudspeaker.

Figure 2:
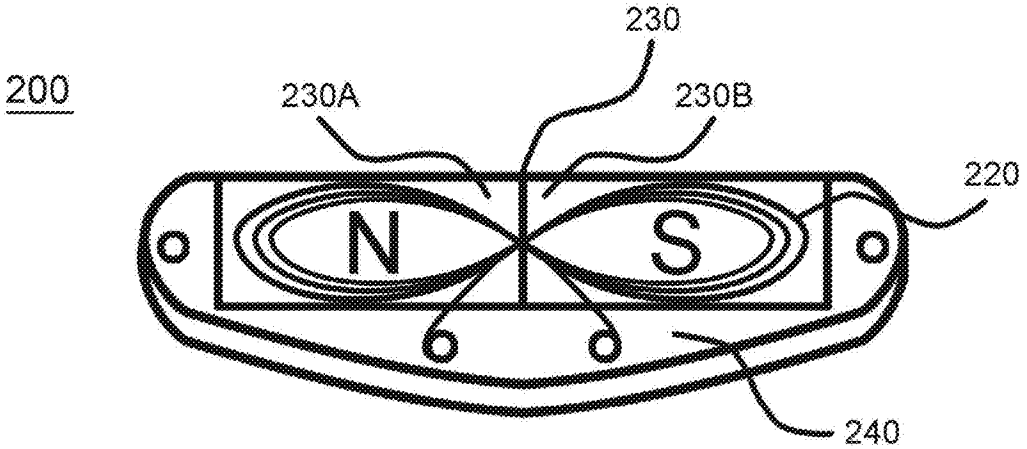
FIG. 2 illustrates an example of a transducer that is constructed in accordance with the principles of the present disclosure.

FIG. 2 illustrates an example of a transducer 200 that is constructed in accordance with the principles of the present disclosure. The transducer 200 includes a permanent magnet 230 that includes a south magnetic pole 230B and north magnetic pole 230A. The transducer 200 also includes a coil 220 that wraps around the permanent magnet in a loop. The loop may include a form of the number 8 or an infinity symbol as shown in the FIG. 1. The transducer 200 may also include a flatwork 240 that supports the permanent magnet and the coil 220. The permanent magnet may include alnico, ferrite, iron, nickel, cobalt, some alloys of rare-earth metals, some naturally occurring minerals such as lodestone, and any other material that may be magnetized. The flatwork 240 may include, e.g., metal, plastic, carbon-fiber, and the like.

Figure 3:
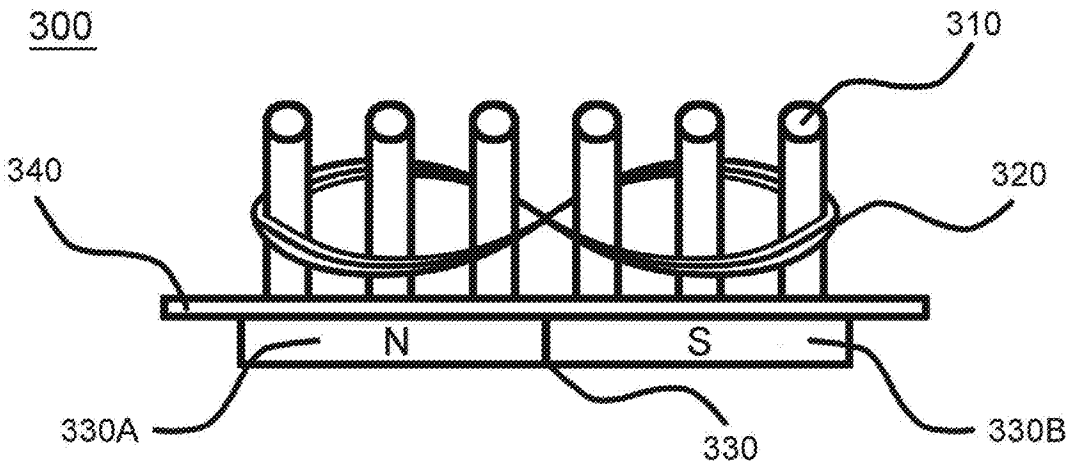
FIG. 3 illustrates another example of a transducer that is constructed in accordance with the principles of the present disclosure.

FIG. 3 illustrates another example of a transducer 300 that is constructed in accordance with the principles of the present disclosure. The transducer 300 includes a permanent magnet 330, at least one ferromagnetic metal pole 310, a coil 320 that loops around the at least one ferromagnetic metal pole 310 in a form of the number 8 (or an infinity symbol), and a bottom flatwork 240, wherein the bottom flatwork 340 is configured to be displaced on top of the permanent magnet 330, wherein the at least one ferromagnetic metal pole 310 is configured to be displaced on top of the permanent magnet 330 and through a hole (not shown) on the bottom flatwork 340, and wherein the coil is configured to connect to an amplifier (not shown). The permanent magnet may further include a north magnetic pole 330A and a south magnetic pole 330B. The permanent magnet generates a magnetic field around the permanent magnet that extends invisibly upward through the metal guitar strings (not shown) above the transducer 300. The guitar strings (not shown) when vibrated cut the lines of flux of the magnetic field of the transducer's permanent magnets. This alteration of the magnetic field generates an electric current in the coil 320 at the same frequencies of the strings' vibrations. The amplifier boosts the electric current, which is turned into a sound via, e.g., loudspeaker. The at least one ferromagnetic metal pole 310 shapes the magnetic field around the permanent magnet.

Figure 4A:
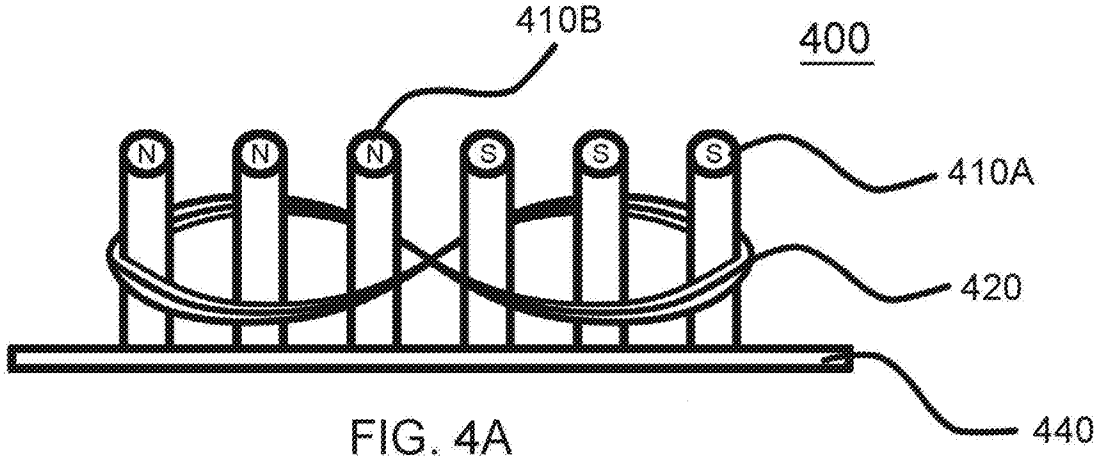
FIG. 4A illustrates another example of a transducer that is constructed in accordance with the principles of the present disclosure.
Figure 4B:
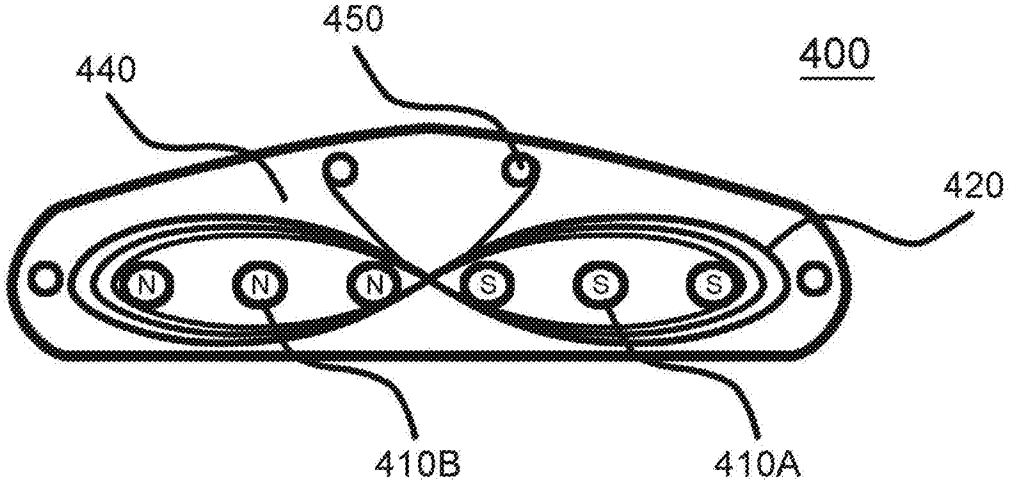
FIG. 4B illustrates a top view of transducer as disclosed in FIG. 4A.

FIG. 4A illustrates a side perspective of yet another example of a transducer 400 that is constructed in accordance with the principles of the present disclosure. The permanent magnet generates a magnetic field around the permanent magnet that extends invisibly upward through the metal guitar strings above the transducer 400. The transducer 400 includes a bottom flatwork 440, at least two magnetic poles, and a coil 420 that is wrapped around the at least two magnetic poles, wherein the at least two magnetic poles include a south magnetic pole 410A and a north magnetic pole 410B. Instead of having a magnet below or on top of the permanent magnet as shown in, e.g., FIGS. 1-2, the transducer 400 includes at least two magnetic poles that both provides and shapes a magnetic field around the transducer 400. FIG. 4B shows a top view of the transducer 400. FIG. 4B illustrates a top view of transducer as disclosed in FIG. 4A. The FIG. 4B shows the coil 420 that ends at coil terminal 450

Figure 5:
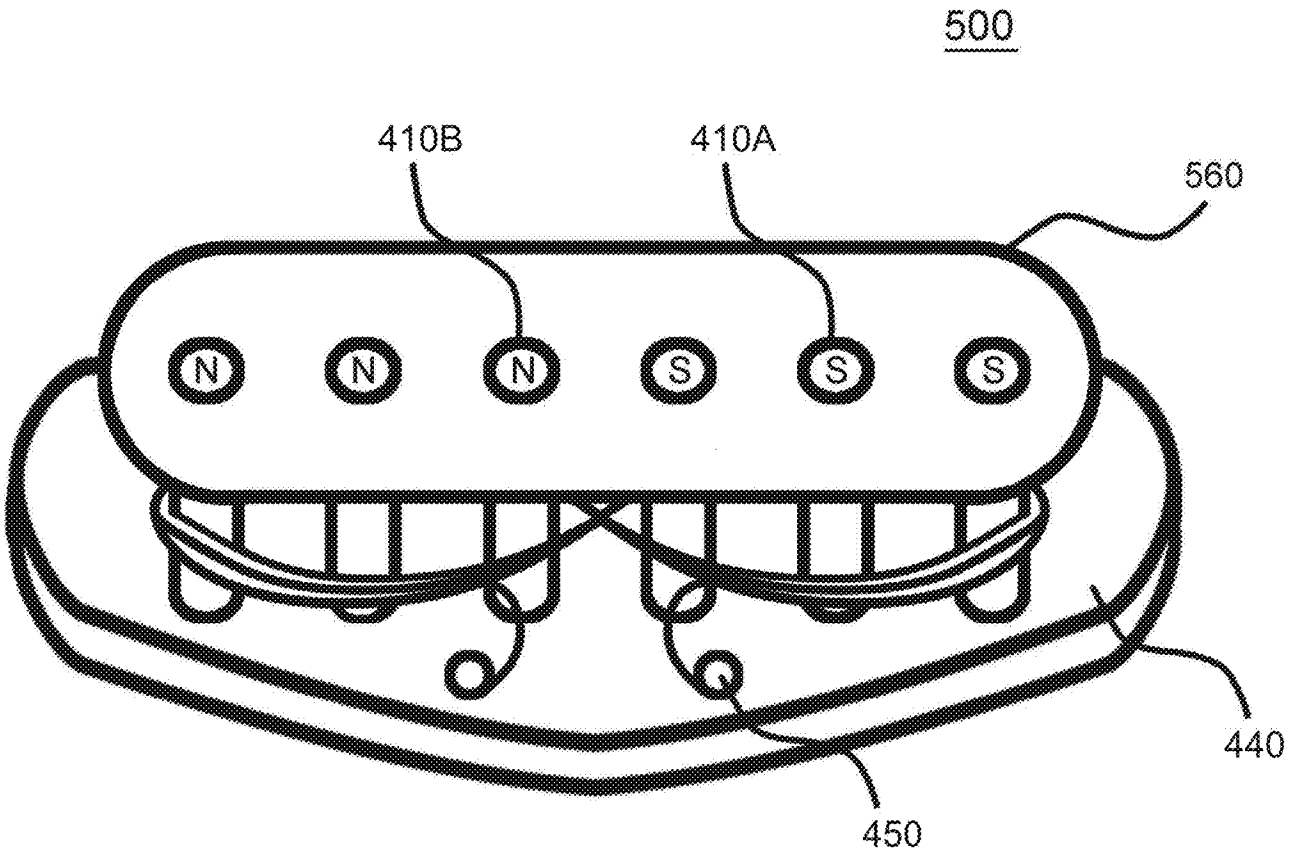
FIG. 5 illustrates a top view of transducer as disclosed in FIGS. 3 and 4A-4B.

FIG. 5 illustrates a top view of transducer as disclosed in FIGS. 3 and 4A-4B. As shown in FIG. 5 and referring to FIGS. 3 and 4A-4B concurrently, the transducer may include a top flatwork 560 that fits over the coil and poles (e.g., at least one ferromagnetic metal pole 310, at least two magnetic poles, and the like).

Figure 6:
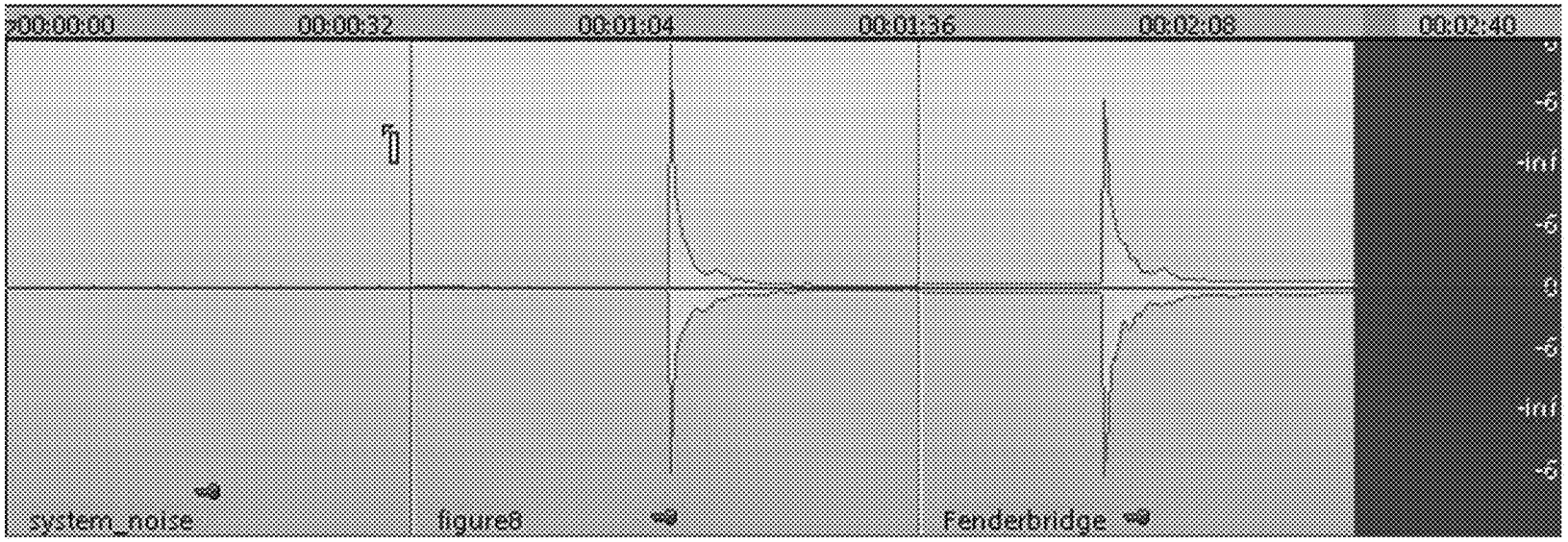
FIG. 6 illustrates a result of effective noise or hum cancellation using an example of a transducer that is constructed in accordance with the principles of the present disclosure.
Figure 7:
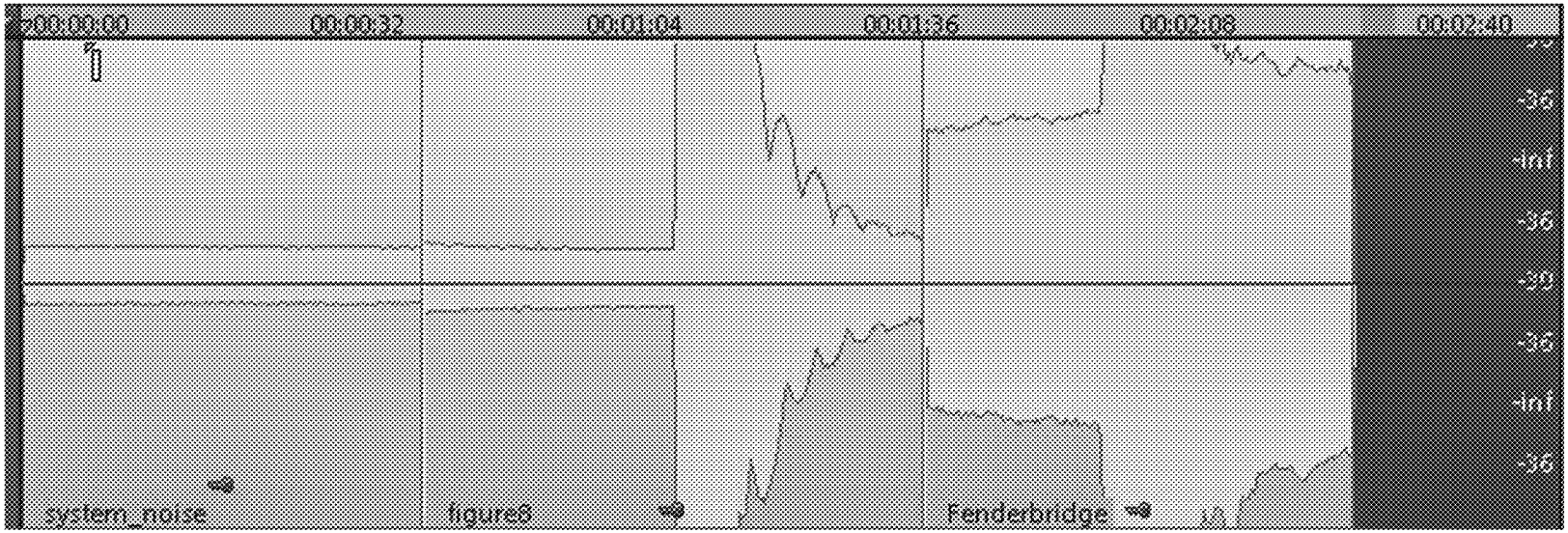
FIG. 7 illustrates a result of effective noise or hum cancellation using an example of a transducer that is constructed in accordance with the principles of the present disclosure.

The embodiments of transducer as shown in, e.g., FIGS. 2, 3, 4A, 4B, and 5, result in effective noise or hum cancellation while retaining single-coil design and sound. Such results are shown in, e.g., FIG. 7 which illustrates a visual comparison of waveforms of a single note (E) played on an electric guitar, picked up by (a) transducer that is constructed in accordance with the present disclosure, in bridge position; and (b) a USA-made Fender Stratocaster pickup, in bridge position. Both guitars are played through the same amplifier (Fender Champ) at the same volume setting (4) with the same microphone (Shure SM57) and signal path. System noise (mic'ing the amplifier with nothing plugged in) is also shown for comparison. FIG. 7 shows a zoomed in results of FIG. 7 to show the noise levels more clearly. Decibel levels are marked on a right section in both FIGS. 6 and 7.

The foregoing description of various embodiments of the invention known to the applicant at this time of filing the application has been presented and is intended for the purposes of illustration and description. The present description is not intended to be exhaustive nor limit the invention to the precise form disclosed and many modifications and variations are possible in the light of the above teachings. The embodiments described serve to explain the principles of the invention and its practical application and to enable others skilled in the art to utilize the invention in various embodiments and with various modifications as are suited to the particular use contemplated. Therefore, it is intended that the invention not be limited to the particular embodiments disclosed for carrying out the invention.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention.

What is claimed is:

1. A string-vibration transducer for an electric instrument having strings comprising:

two permanent magnets;

at least two ferromagnetic metal poles;

a coil that is configured to loop around the at least two ferromagnetic metal poles; and a bottom flatwork comprising at least two apertures to receive the at least two ferromagnetic metal poles, wherein each permanent magnet comprises a north magnetic pole and a south magnetic pole, wherein the at least two ferromagnetic metal poles are configured to be displaced on top of the permanent magnets and through the at least two apertures on the bottom flatwork, wherein the coil is configured to loop around the at least two ferromagnetic metal poles to comprise two loops in a shape of figure eight, and wherein the bottom flatwork is configured to be on top of the permanent magnets.

2. The transducer of claim 1, wherein the permanent magnet associated with the first loop of first ferromagnetic metal pole is magnetically polarized opposite to the permanent magnet associated with the second loop of second ferromagnetic metal pole.

3. The transducer of claim 2, wherein the first ferromagnetic metal pole is arranged within the first loop of the coil such that the first ferromagnetic metal pole and the first loop of the coil have same magnetic polarity.

4. The transducer of claim 2, wherein the second ferromagnetic metal pole is arranged within the second loop of the coil such that the second ferromagnetic metal pole and the second loop of the coil have same magnetic polarity.

5. The transducer of claim 1, wherein the bottom flatwork comprises a non-metallic plate.

6. The transducer of claim 1, wherein the at least two ferromagnetic metal poles are configured to transfer the magnetic field of the permanent magnets through their length.

7. The transducer of claim 1, wherein the at least two ferromagnetic metal poles are cylindrical in shape.

8. The transducer of claim 1, wherein the at least two ferromagnetic metal poles are made from at least one of: ALNICO II, ALNICO III, ALNICO V, ALNICO VIII, mild steel, of any combination thereof.

9. The transducer of claim 1, wherein the permanent magnets comprise a pair of adjacent rectangular magnets, magnetized through the thickness, such that the magnetic fields face the strings.

10. The transducer of claim 1, wherein the permanent magnets are configured to be underneath the two loops of the coil.

11. The transducer of claim 1, wherein the coil has between 1,000 to 9,000 turns.

12. The transducer of claim 1, wherein the coil has more than 9,000 turns.

13. The transducer of claim 1, wherein the coil has less than 1,000 turns.

14. The transducer of claim 1, wherein the coil has about 6,000 turns.

* * * * *